United States Patent [19]

Schramm et al.

[11] 4,231,798

[45] Nov. 4, 1980

[54] ALLOY CARRIER FOR CHARGING CUPOLA FURNACES

[75] Inventors: Hans Schramm; Klaus Schramm, both of Essen, Fed. Rep. of Germany

[73] Assignee: Frank & Schulte GmbH, Essen, Fed. Rep. of Germany

[21] Appl. No.: 39,938

[22] Filed: May 17, 1979

[51] Int. Cl.[3] ..... C22C 37/00

[52] U.S. Cl. ..... 75/256; 75/130 R

[58] Field of Search ..... 75/256, 130 R

[56] References Cited

U.S. PATENT DOCUMENTS

| | | | |
|---|---|---|---|
| 1,666,312 | 4/1928 | Runyan | 75/256 |
| 1,869,925 | 8/1932 | Turnbull | 75/256 |
| 2,497,745 | 2/1950 | Stohr | 75/256 |

*Primary Examiner*—M. J. Andrews

*Attorney, Agent, or Firm*—Allison C. Collard; Thomas M. Galgano

[57] ABSTRACT

Alloy carrier for charging cupola furnaces, the carriers having the form of bodies molded with cement, the alloys being manganese as ferromanganese and silicon in the following composition 8–40% Mn
9–22% C
2–9% Fe
18–45% Si
15–30% Portland Cement
4–8% $H_2O$ chemically bound
2–7% residue components (all percentages by weight)

wherein the manganese carrier is ferromanganese carbure and the silicon carrier is silicon carbide.

1 Claim, No Drawings

ALLOY CARRIER FOR CHARGING CUPOLA FURNACES

The present invention relates to an alloy carrier for charging cupola furnaces in the form of bodies molded with cement, which contain manganese as ferromanganese and silicon in the following composition:

8–40% Mn
9–22% C
2–9% Fe
18–45% Si
15–30% Portland Cement
4–8% $H_2O$ chemically bound
2–7% residue components, all percentages by weight.

In the alloy carriers known in this art, the carriers for the alloys contain silicon as ferrosilicon and manganese in the form of ferromanganese. In the alloy carriers known in the art, in order to obtain a rapid dissolution and even distribution of the alloy component manganese in the melt, high grade, low-carbon ferromanganese, called Ferromanganese affine, (carbon content 0.5% to 2%) or ferromanganese suraffine (carbon content 0.05% to 0.5%) has to be used. However, it is not possible to use the considerably cheaper ferromanganese of the grade ferromanganese carbure (carbon content 6% to 8%), because ferromanganese with such a high carbon content contains the manganese mostly in the form of carbides which are difficult to disintegrate, i.e., they are relatively inert or non-reactive.

The prices for the ferromanganese affine and suraffine grades are twice or three times as high as those of ferromanganese carbure, because the production costs are very much higher. In addition to their high costs, the grades ferromanganese affine or suraffine have the disadvantage that they are burned to a comparatively high degree, particularly in a hot air cupola furnace. The loss by burning off already occurs in the upper range of the furnace shaft of the hot air cupola furnace, where temperatures of 800° C. to 1,150° C. and mostly oxidizing conditions exist, so the ferromanganese low in carbon is oxidized due to its high affinity to oxygen.

It is therefore an object of the present invention to provide alloy carriers of the aforementioned type, which are more cheaply produced and which are improved with respect to their loss by burning off. These objects are achieved according to the instant invention by using as the carrier for manganese, ferromanganese carbure, and, as the silicon carrier, silicon carbide.

Upon charging the alloy carrier according to the present invention into the hot air cupola furnace, oxidation of the alloy components in the upper range of the furnace shaft is avoided as much as possible. The high-carbon ferromanganese and especially the silicon carbide, are very stable to oxidizing gases. Moreover, the very stable silicon carbide forms a protective wrapping in the molded body for the ferromanganese. Above 1,150° C., i.e., in the beginning slag zone, the molded body starts to dissolve, and therewith occurs the dissolution and disintegration of the ferromanganese and the silicon carbide. In that process, the large amount of heat liberated during the oxidation of the components of the dissolving silicon brings about an accelerated disintegration of the carbides of the highly carbonated ferromanganese, which are difficult to decompose, so that the manganese is liberated and fully effective at just the right moment. The activating effect of the silicon carbide on the highly carbonated ferromanganese is so potent that with the considerably less expensive starting material, better results are obtained in the production and the even distribution than with the expensive, low-carbon ferromanganese grades. Moreover, the carbon set free from the silicon carbide and the highly carbonated ferromanganese, which is present in statu nascendi and very reaction-prone, effects a lasting deoxidation of the slag. In testing, decreased contents in manganese oxide and iron oxide in the slag were observed, as well as higher yields in silicon and manganese in the cast iron. In addition, a much better desulfurization of the cast iron was obtained.

In the following two examples, two types of alloy carriers, according to the present invention, are illustrated, having the following composition:

| TYPE I | TYPE II |
|---|---|
| 30–40% Mn | 8–30% Mn |
| 9–15% C | 15–20% C |
| 5– 9% Fe | 2– 5% Fe |
| 18–25% Si from SiC | 25–45% Si from SiC |
| 15–20% Portland Cement | 20–30% Portland Cement |
| 4– 6% $H_2O$ chemically bound | 5– 8% $H_2O$ chemically bound |
| 2– 7% residue components | 2– 7% residue components |

Type I is particularly suited for alloying cast iron with manganese and silicon, as well as for deoxidation. Type II substantially avoids formation of iron sulfide and manganese sulfide in cast iron.

Thus, while only two examples of the present invention have been shown and described, it will be obvious to those skilled in the art that other changes and variations can be made in carrying out the present invention, without departing from the spirit and scope thereof, as defined in the appended claims.

What is claimed is:

1. An alloy carrier for charging cupola furnaces, the carrier having the form of bodies molded with cement, the alloys being manganese in the form of ferromanganese and silicon, in the following composition:

8–40% by weight, Mn
9–22% by weight, C
2–9% by weight, Fe
18–45% by weight, Si
15–30% by weight, Portland Cement
4–8% $H_2O$, chemically bound
2–7% impurities characterized by the employment of ferromanganese carbure having a carbon content of 6% to 8% as the manganese carrier and silicon carbide as the silicon carrier.

* * * * *